United States Patent [19]

Reibling

[11] 4,188,657

[45] Feb. 12, 1980

[54] REFLECTOR AND METHOD OF PRODUCING DIFFERENT, DISTINCTIVE AND PREDICTABLE LIGHT PATTERNS THEREFROM

[75] Inventor: Robert L. Reibling, Ft. Thomas, Ky.

[73] Assignee: Whiteway Manufacturing Co., Inc., Cincinnati, Ohio

[21] Appl. No.: 642,333

[22] Filed: Dec. 19, 1975

Related U.S. Application Data

[63] Continuation of Ser. No. 379,107, Jul. 13, 1973, abandoned.

[51] Int. Cl.[2] ..... F21V 7/09

[52] U.S. Cl. ..... 362/348

[58] Field of Search ..... 240/41.35 R, 41.35 A, 240/41.36, 41.5, 103 R, 103 B, 41 R, 41 B, 41.38 R, 46.47, 46.25, 103 A, 41.35 C, 41.35 F, 44.1; 350/293, 294, 292

[56] References Cited

U.S. PATENT DOCUMENTS

| | | | |
|---|---|---|---|
| 1,200,587 | 10/1916 | Cloninger | 240/41.35 R X |
| 1,222,312 | 4/1917 | McKeever | 240/41.35 R |
| 1,347,268 | 7/1920 | Godley | 240/41.36 |
| 1,523,841 | 1/1925 | Schoonmaker | 240/41.36 |
| 1,641,714 | 9/1927 | Whalen | 240/41.36 |
| 1,718,856 | 6/1929 | Durfee et al. | 240/46.47 |
| 1,799,711 | 4/1931 | Vande | 240/41.25 X |
| 1,837,147 | 12/1931 | Champeau | 240/41.35 R |
| 1,875,384 | 9/1932 | Lucas | 240/41.38 R |
| 2,346,717 | 4/1944 | Ainsworth | 240/103 B X |
| 2,913,569 | 11/1959 | Edelstein | 240/103 B |
| 3,099,403 | 7/1963 | Strawick | 240/103 B |
| 3,283,142 | 11/1966 | Freeman | 240/41.36 |
| 3,578,965 | 5/1971 | Tawil et al. | 240/41.35 F |
| 3,633,025 | 1/1972 | Johnson | 240/103 B |
| 3,746,854 | 7/1973 | Brass | 240/103 R |

FOREIGN PATENT DOCUMENTS

| | | | |
|---|---|---|---|
| 1038498 | 9/1958 | Fed. Rep. of Germany | 240/41.35 R |

*Primary Examiner*—Donald A. Griffin
*Attorney, Agent, or Firm*—Kinney & Schenk

[57] ABSTRACT

A reflector comprising a pair of mirror-image reflector half-sections is adapted to produce a plurality of different, distinctive and predictable light patterns by utilizing various combinations of reflective surface finishes on the reflective surfaces of the reflector half-sections.

19 Claims, 19 Drawing Figures

CANDLEPOWER DISTRIBUTION

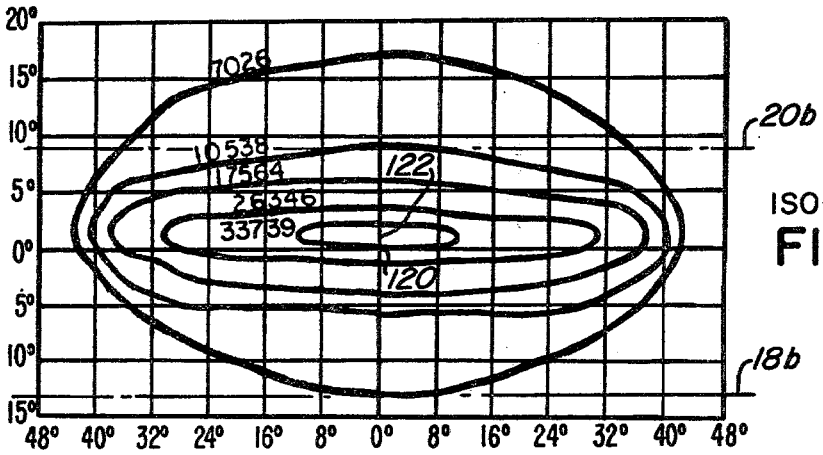
ISO-CANDLE CURVES
FIG-15
CANDLEPOWER DISTRIBUTION
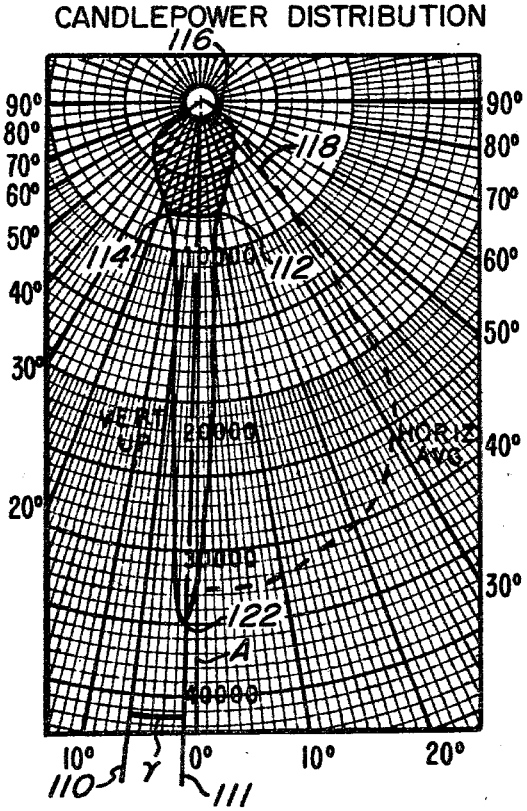
FIG-14
FIG-16
CANDLEPOWER DISTRIBUTION
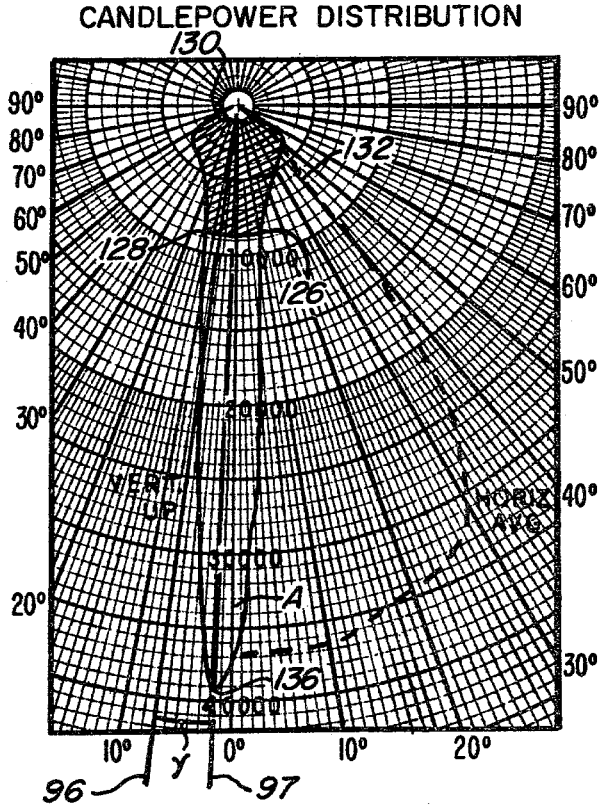
FIG-17
ISO-CANDLE CURVES
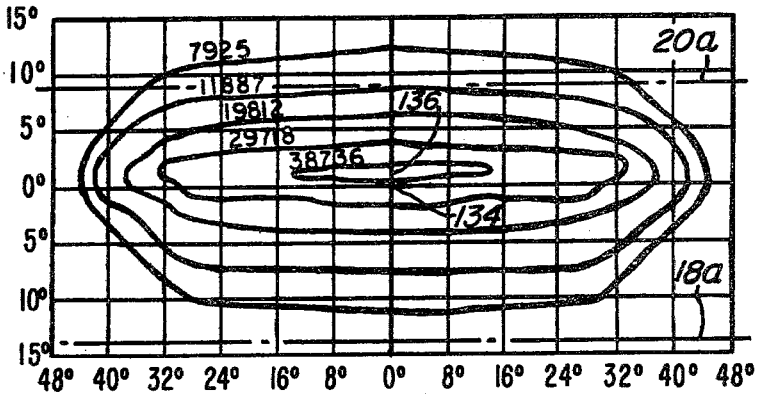

REFLECTOR AND METHOD OF PRODUCING DIFFERENT, DISTINCTIVE AND PREDICTABLE LIGHT PATTERNS THEREFROM

This is a continuation of application Ser. No. 379,107, filed July 13, 1973 now abandoned.

BACKGROUND OF THE INVENTION

Reflectors fall into two generic classifications: diverging and converging. A diverging reflector scatters light directed toward it, and has a focal center generally on or behind the reflector surface, often being a convex or flat reflector rather than concave. Converging reflectors are in the family of concave reflectors having focal centers in front of the reflector surface. The extreme concave reflector is a circular reflector having a focal center at the radius. In that case, a lamp placed at the focal center directs light to the reflector, the reflector then reflecting the light back to the focal center. Less extreme converging reflectors are produced by elliptical surfaces wherein the two centers of the ellipse generate plural focal points. In the case of elliptical reflectors, light generated at one focal center is reflected to and converges at the second focal point.

Situated between the converging and diverging reflector classes is a reflector that generates a light pattern parallel to the reflector axis. The reflector is essentially a converging reflector, the converging point being located at infinity. This type of reflector is created by a parabolic surface, wherein the light source is placed at the first focal center, which is in fact the geometric center of the parabolic curve, directing light to the reflector surface and therefrom toward a second focal point at infinity. Thus, the light is actually parallel to the reflector axis defined by a line passing through the two focal centers of the reflector and the reflector zenith.

Therefore, a converging reflector is defined as any reflector having a configuration wherein the two sides of the reflector approach parallel asymptotes or actually converge at a fixed distant point, ranging anywhere from the parabola to the circle.

A diverging reflector may be created by simply distorting the parabola to a slight degree so that the light beam scatters rather than converges at infinity. Essentially, diverging means that the light converges at a point behind the reflector, i.e. the focal center behind or on the reflector surface. As the reflector surface becomes less concave, the more scattered the reflecting light beam. Thus, a diverging reflector includes straight, convex, and the family of concave configurations wider than a parabola.

Most lamp reflectors are necessarily confined to the family of converging reflectors, in order to provide a controlled beam pattern. To generate the necessary variable intensity for large surface lighting the reflector is generally a combination of two or more distinct converging reflector surfaces.

The focal centers of a reflector generally are the geometric centers of the curve defining the reflector cross-section, light being directed therefrom to the reflector surface and then reflecting from the reflector surface at a reflection angle equal to the angle of incidence. Thus, when an elliptical surface is used, the light emitted from one focal point automatically converges at the second focal point. Likewise, when a parabolic reflector is utilized and a light source is placed at the geometric center, the reflected light beam is parallel to the reflector axis, the light beam theoretically converging at a second focal point at infinity.

The point on the reflector surface at which a normal line extending therefrom also passes through the geometric or focal center of the reflector curve is defined as the reflector zenith. This normal line is defined as the axis of the reflector.

The present invention relates to concave reflectors and luminaires for use in asymmetrical light distribution. When illuminating a vertical surface such as a building facia, an advertising sign or the like, it is necessary to provide a variable lighting intensity generating uniform coverge over the entire surface area, to provide visual appeal and readability to the illuminated surface.

The ideal lighting luminaire should have an optical system that will generate a controlled asymmetric vertical light beam pattern on a surface to be illuminated. Maximum candle power should occur at the upper limits of the working beam with a linear decrease in candle power toward the bottom of the beam. The lateral beam plane should have minimal candle power decrease throughout a wide horizontal sweep. This permits illumination of a vertical planar surface with substantially uniform brightness from top to bottom while retaining broadest uniform lateral coverage across the illuminated surface in those instances in which the luminaire is mounted at or adjacent the base of said surface.

In the past, two basic optical designs have been utilized for vertical surface lighting applications: asymmetrical reflector surface contours with lamps positioned either parallel or perpendicular to the surface, and symmetrical reflector surface contours with the lamps positioned parallel to the surface.

The asymmetric reflector contour with lamps positioned parallel to a planar surface has the capabilities to develop an asymmetric beam pattern having acceptable vertical illumination patterns for overall surface illumination. However, each reflector configuration produces only a single pattern of light, limiting application of the asymmetric reflector to a single purpose. The asymmetric reflector contour with a lamp positioned perpendicular to a vertical surface provides generally undesirable asymmetric light patterns due to the length of the light source arc tube. When utilizing asymmetric reflector configurations, an asymmetric light pattern is realized in the horizontal as well as the vertical plane. The beam classification is wide angle, producing but one single beam.

Symmetric reflector contours with lamps positioned parallel to a vertical surface generate a controlled symmetric vertical and horizontal light pattern with a maximum beam width in the lateral or horizontal plane. The symmetric light pattern will generate the maximum candle power at the center of the beam, that is, along the axis of the reflector, with decreasing candle power as the distance increases from the axis. The light pattern is effective in the horizontal plane, however, the vertical portions of the beam will not effectively cover the surface height to achieve proper uniformity. Normally, the maximum candle power at the center of the beam is aimed at the top of the surface to be illuminated in an attempt to satisfy the uniformity requirement. This method will waste the upper half of the light beam, causing lower total lumen efficiency of the light generated by the luminaire.

The present invention utilizes both asymmetric and symmetric working beam patterns to produce an efficient, uniform light pattern on a vertical surface. The reflector of the present invention consists of two identical reflector halves that are coupled together to produce various predetermined light patterns. The reflector half-sections are defined by parabolic contours in single or multiple steps. Each reflector half-section is mechanically identical with the exception of the reflecting surface finish. The surface finishes range in various degrees of diffused to specular surfaces and account for the different asymmetric vertical light patterns when used in combination while retaining the symmetric horizontal patterns of a symmetric reflector. A proper selection of reflector half combinations, when angularly directed at the vertical surface, will result in higher total lumen efficiency and a controlled uniform brightness coverage on the lighted surface. The selection of proper reflector combinations will also permit mounting locations closer to a vertical surface than previously practical. The range of reflector combinations provides the lighting designer with proper optical selections, particularly where mounting locations are limited.

Prior art devices can only generate an asymmetrical vertical light pattern by utilizing asymmetric reflector halves, thus decreasing the symmetrical wide range lateral or horizontal pattern required when lighting a perpendicular planar surface. The present invention permits the retention of ideal symmetrical reflectors for maintaining a wide lateral intensity while permitting a varying beam strength in the vertical direction, thus permitting substantially even intensity on a planar illuminated surface. Further, by utilizing the proper selected surface finishes, the amount of wasted light can be greatly reduced, thereby contributing to the overall lamp efficiency and aesthetic appearance of the illuminated surface. The versatility of the present invention permits the utilization of the reflector sections to produce a variety of asymmetric or, where desired, symmetric lighting patterns. For example, the symmetric pattern for wide, narrow, or medium light patterns may be generated, as well as asymmetric patterns combining any combination of wide, medium, and narrow beam patterns. Thus, the present invention presents a basic and fundamental variance from prior art systems, in that it provides a reflector for generating an asymmetric light pattern with the use of any of a plurality of symmetric reflector configurations.

All other attempts to produce a suitable asymmetric pattern to provide substantially uniform intensity on a vertical lighted surface have utilized asymmetric reflectors. An example of a suitable asymmetric reflector, providing a vertical lighting pattern is disclosed in U.S. Pat. No. 3,679,893. As illustrated therein, the reflector comprises two portions, one portion being an elliptical reflector section while the other portion consists of the plurality of parabolic reflector sections to produce the particular lighting pattern illustrated in FIGS. 4 and 5 of that patent. As can be seen, the candle power is greatest at the top of the beam and least at the bottom to provide substantially uniform illumination of a definite or particular light pattern. However, use of the asymmetric reflector of U.S. Pat. No. 3,679,893 will reduce the efficiency and desired output of the lateral or horizontal range of the lamp. If a different pattern of illumination is desired, that is, one having either less or greater height than illustrated in FIGS. 4 and 5 of the aforesaid patent, it becomes necessary to redesign the shape of the two reflective portions which collectively constitute the reflector of said patent.

In sharp contrast thereto, the present invention enables a plurality of different, distinctive, and predictable light patterns to be obtained from a pair of identically shaped, mirror-image reflector half-sections by controlling the reflectance factor, that is, the reflective surface finish, per se, of each half-section.

Further, the present invention is particularly versatile, generating an entire family of light patterns, reducing the amount of wasted light generated by the luminaire, thereby increasing the overall efficiency of the luminaire.

SUMMARY OF THE INVENTION

The present invention is directed to apparatus for and a method of producing an asymmetric light pattern by means of a symmetric reflector composed of identical half sections joined at the axis for simultaneously generating asymmetric vertical and symmetric horizontal light patterns.

The reflector of the present invention is made of symmetrical, complementary half-sections, each half section being identical with the other and having coinciding focal centers and zeniths falling on an identical reflector axis. The half-sections are coupled to form a symmetrical reflector having a singular focal center and zenith defining a reflector axis. Each half-section includes a distinct reflecting surface finish having a predetermined reflectance factor for emitting light in predetermined varying vertical patterns, while the symmetric shape produces fairly constant, wide span horizontal patterns.

The reflector may include a plurality of parabolic reflector sections each having a theorectical zenith falling on the axis of the reflector. Between each reflector section is an off-set or non-reflective transition surface for coupling the sections and preventing beams from reflecting back into the focal center, creating heat concentration at the source.

DESCRIPTION OF THE DRAWINGS

FIG. 14 is a candle power distribution polar graph of the specular/diffused beam pattern.

FIG. 15 is the iso-candle curve of the specular/diffused beam pattern.

FIG. 16 is the candle power distribution polargraph of the semi-specular/specular beam pattern.

FIG. 17 is the iso-candle curve of the semi-specular/-specular beam pattern.

DETAILED DESCRIPTION

Figure 1:
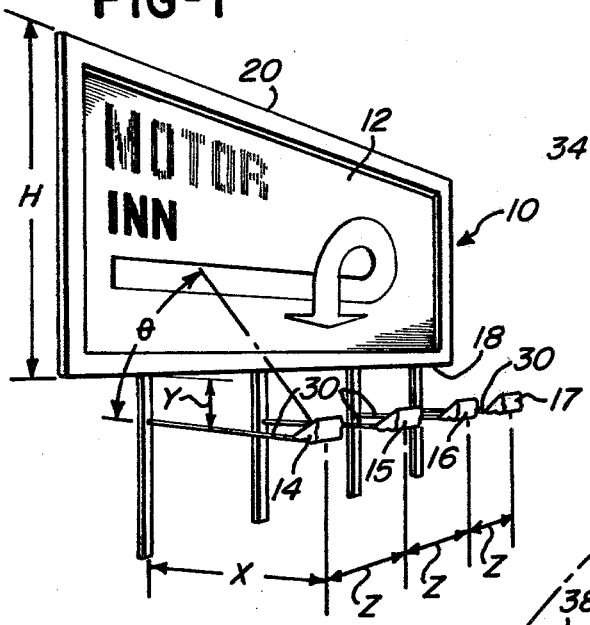
FIG. 1 is a perspective view of a typical signboard including the luminaires of the present invention.
Figure 2:
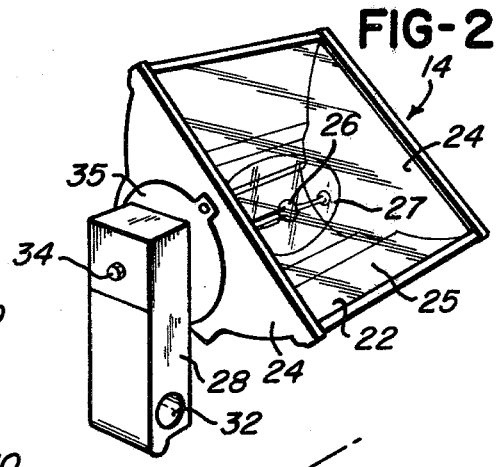
FIG. 2 is an enlarged perspective view of the luminaire.
Figure 3:
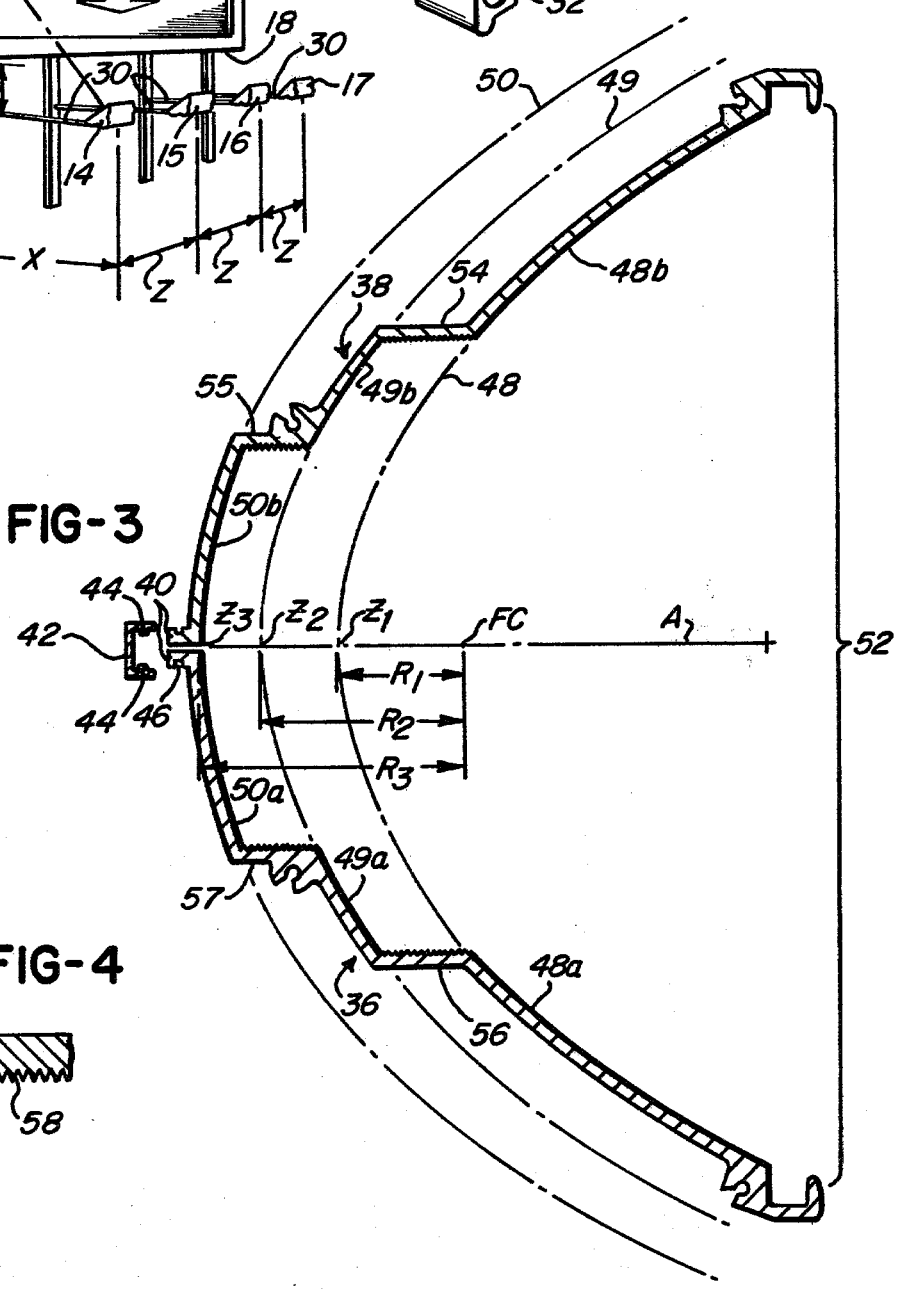
FIG. 3 is a vertical cross-section of a preferred reflector configuration embodying the teachings of the present invention.

FIGS. 1 and 2 illustrate the environment of the invention, FIGS. 3–6 illustrate various embodiments of the reflector shapes, and FIGS. 7–17 illustrate various light emission patterns which can be generated by selecting certain combinations of finishes of the reflector of FIG. 3.

With reference to FIG. 1, the numeral 10 denotes generally a typical signboard having a vertical planar surface 12 adapted to be illuminated by luminaires 14, 15, 16, and 17. The luminaires may be mounted above the signboard or below, however, for purposes of disclosure the luminaires will be mounted at the base of the vertical surface to be illuminated, as illustrated. Ideally, the luminaires are set back from the signboard a distance "X", and down from the base thereof a distance "Y" to eliminate interference with the line of sight. The height "H", the setback "X" and the drop "Y" determine the mounting angle "$\theta$" at which the luminaires should be mounted to provide the most efficient overall illumination of the vertical surface 12. The angle "$\theta$" is defined as the included angle between the light beam or center axis of the luminaire and a line perpendicular to surface 12. The distance "Z" between the various luminaires is determined by the width or lateral range of the light pattern generated by each luminaire.

Since the source of light, i.e. luminaires 14–17 are mounted closer to the base 18 than the top 20 of the signboard, it is desirable to have the strongest portion of the beam directed to the top or most distant point of the signboard and the weakest portion directed toward the bottom. The intensity of the light pattern should linearly decrease from top to bottom to ensure greater uniformity of brightness on the lighted surface, thus enhancing readability. Further, it is desirable to maintain broadest possible lateral coverage to keep the distance "Z" maximum, thereby requiring the least number of luminaires to adequately illuminate a given area, such as the signboard 10.

As illustrated in FIG. 2, luminaire 14 includes a symmetric concave reflector 22, end walls 24 and a lens 25 which collectively define a lighting chamber. A high intensity arc lamp 26 encased in glass envelope 27 is positioned at the focal center of the reflector to provide a suitable light source. The lamp may be any of a variety of lamps generally referred to as high intensity discharge lamps.

Figure 4:
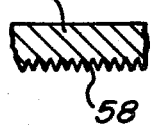
FIG. 4 is an enlarged segment of the reflector of FIG. 3, showing a detail of one non-reflecting transition surface thereof.

Reflector 22 is any of a variety of symmetrical configurations, the preferred embodiment being illustrated in FIGS. 3 and 4. The front opening 52 of the luminaire is adapted to receive transparent lens 25. Each luminaire, see FIG. 2, is adapted to be adjustably supported via mounting post 28 to the mounting location providing the most desirable illumination of surface 12. For example, it is common to secure each mounting post 28 to one pf a plurality of horizontal supports 30 provided on signboard 10. Electrical wiring may then be supplied via the support 30 and through access opening 32 to lamp 26. The luminaire is pivotally mounted to post 28 at 34, and includes an angle plate 35 for angularly adjusting the luminaire to set the angle $\theta$ upon installation.

As stated, the reflector 22 can be any variety of symmetrical configurations, the vertical cross-section of the preferred embodiment being illustrated in FIG. 3. The reflector surfaces 48, 49, and 50 each are parabolic surfaces so positioned to have a coinciding focal center FC. The surfaces also each have an identical and coinciding axis A. Each geometrical zenith $Z_1$, $Z_2$ and $Z_3$ are located on axis A. Unlike previous lamp reflectors for generating an asymmetric light beam, the present reflector comprises identical complementary half sections, 36 and 38, one above and one below axis A. The half sections each have an elongate rearwardly projecting track defining member 40 having an elongate groove 46 therein which is dimensioned to receive the elongate ribs 44 of an elongate coupling member 42, thereby holding and interlocking the half sections in proper relationship. In this manner, halves 36 and 38 may be interchanged, creating an entire family of reflectors for use with the luminaires 14–17.

As shown in phantom in FIG. 3, reflector half sections 36 and 38 actually generate a series of continuous parabolic curves 48–50 formed of sections 48*a*, 48*b*; 49*a*, 49*b*; and 50*a*, 50*b*, respectively. Due to size limitations, it is desirable to provide a reflector that will accept the largest lamp envelope 27 (see FIG. 2) while maintaining the smallest frontal opening 52. For this reason, the family of parabolic reflectors 48–50 is assembled with coinciding focal center FC. As illustrated, if curve 48 is utilized to provide a simple parabolic reflector having front opening 52, the lamp envelope 27 would be limited to radius $R_1$. Likewise, a two-step reflector utilizing curves 48 and 49 in combination would permit an envelope radius $R_2$, while the three step reflector utilizing curves 48, 49 and 50 in combination, accommodates a lamp envelope having a maximum radius $R_3$. If the curve 50 is utilized to generate a single step reflector accommodating a lamp envelope of radius $R_3$, the front opening 52 would be increased, requiring a larger luminaire. Thus, the number of surfaces utilized in combination to generate the reflector 22 of luminaire 14 as shown in FIG. 2 is dependent only upon two factors: (1) the radius of the lamp envelope 27, and (2) the desired size of the front opening 52. Transition surfaces 54 and 55 are provided between the adjacent ends of reflector surfaces 48*b*–49*b* and sections 49*b* and 50*b*, respectively, whereas transition surfaces 56 and 57 are provided between adjacent ends of reflector surfaces 48*a*–49*a* and 49*a*–50*a*, respectively. The transition surfaces serve only to provide each half section with a continuous surface for ease in manufacturing and assembly. Ideally a void could be placed between each parabolic curve section without impairing the reflective qualities of the configuration illustrated in FIG. 3. For this reason, the surface of each transition surface element is either non-reflecting or scatters at random any light being directed to it. To achieve this, the surface of each member is substantially parallel to the axis A of the reflector, and includes serrations 58 to provide an uneven surface ensuring that light directed thereto from focal center FC is not then reflected back into the focal center, see FIG. 4. Thus, the only reflecting surfaces are surfaces 48*a*, 49*a*, 50*a*, 48*b*, 49*b*, and 50*b*. Each of these are parabolic surfaces generating a light beam parallel to axis A when the source is placed at focal center FC.

Figure 5:
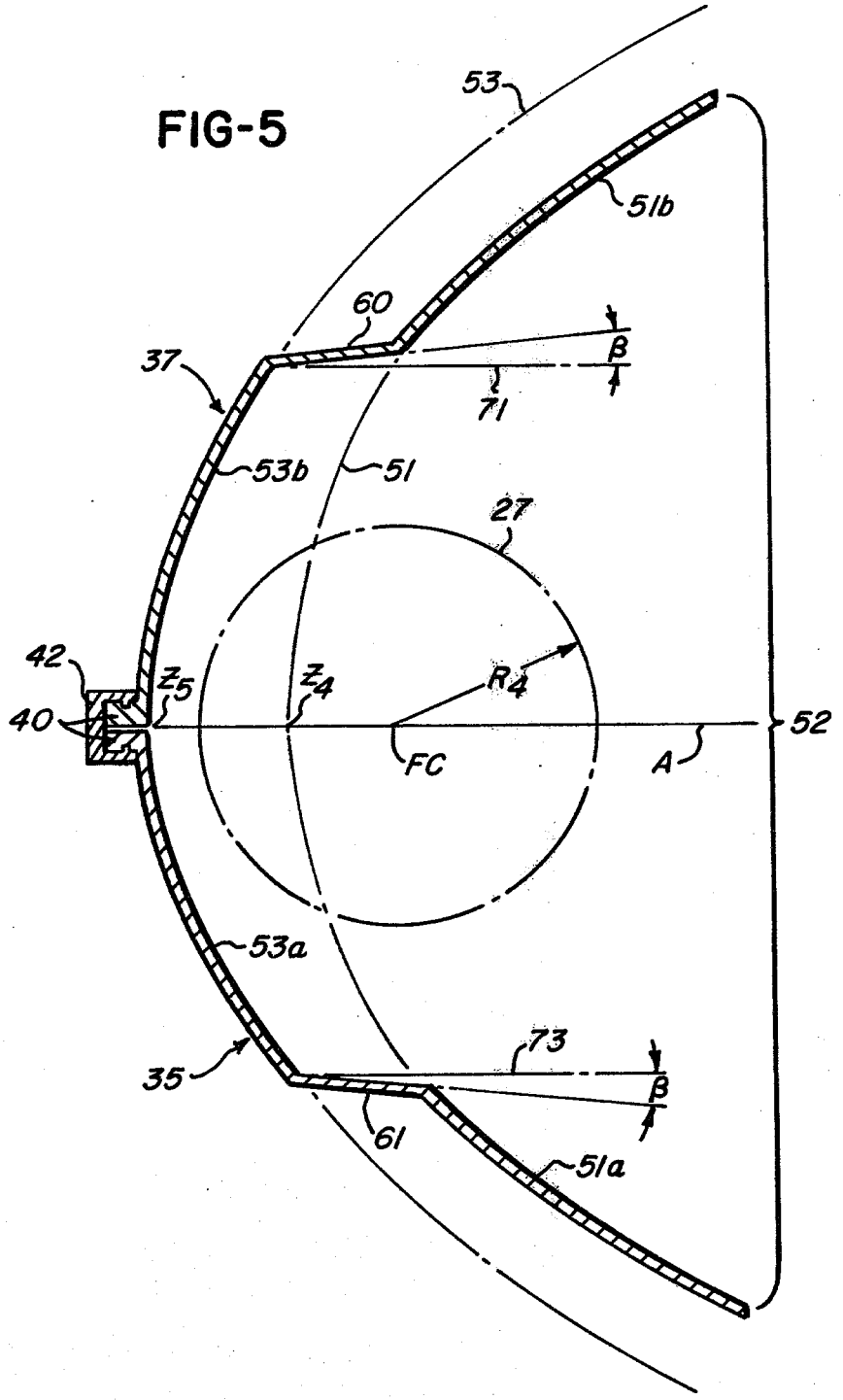
FIG. 5 is a view similar to FIG. 3 illustrating a modification of the reflector configuration.
Figure 6:
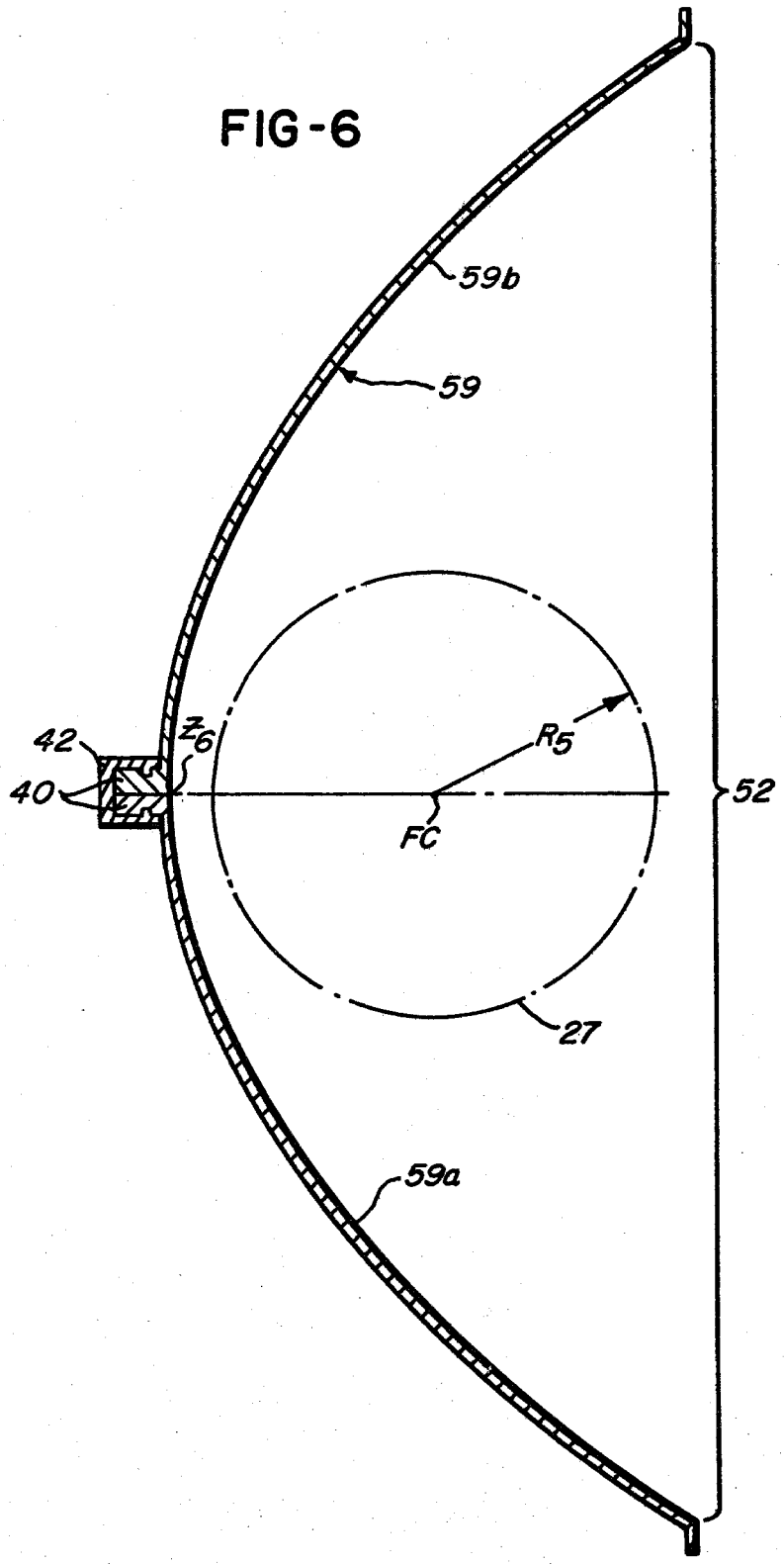
FIG. 6 is a view similar to FIG. 3 illustrating another modification of the reflector configuration.

Alternative embodiments of reflector 22 are illustrated in FIGS. 5 and 6, FIG. 5 containing a two-step reflector and FIG. 6 showing the simplest reflector configuration, having a single parabolic surface. Again, the only factors concerning the number of curves required are the desired size of the frontal opening 52 and the radius of lamp envelope 27. Where at least one of these factors is not critical, the single step reflector of FIG. 6 may be utilized. The reflector of FIG. 5 is a two-step combination reflector generated from parabolic curves 51 and 53, shown in phantom. As with the reflector of FIG. 3, halves 35 and 37 are of identical cross-section, being joined at the reflector zenith $Z_5$ by clamp 42. The curves 50 and 51 are so joined that their focal centers coincide at FC and their respective zeniths $Z_4$ and $Z_5$ fall on the same axis A. As can be seen, the reflector of FIG. 5 will accommodate a lamp envelope 27 having radius $R_4$, while requiring a front opening 52 substantially smaller than the front opening required if parabolic curve 53 alone defined the reflector. Other than the reduction of the number of curve sections with coinciding focal centers, FIG. 5 only varies from the preferred embodiment of FIGS. 3 and 4 in that the transition surfaces 60 and 61 have a smooth surface finished to the same reflectance factor as the remaining portion of their respective reflector halves 37 and 35. Each transition surface 60 and 61 is respectively off-set from a line 71 or 73 parallel with the axis A by the angle $\beta$. The angle $\beta$ is generally in the range of 2°14 5° and ensures that the light directed from the focal center FC does not reflect back into the focal center but is directed to a point in front thereof. Again, it is not necessary that any light be reflected in the transition region defined by the transition surfaces. However, since it is impractical to utilize a void at these points, it is desirable that any light reflected from the transition surface be directed away from the focal center, ensuring that reflected light does not there converge, generating an over heated condition at the source. It should be understood that any transition surface could be utilized without departing from the spirit of the invention.

The reflector of FIG. 6 is generated from a single parabolic curve having a focal center at FC. The reflector is halved into identical sections 59*a* and 59*b* and coupled by clamp 42 at the reflector zenith $Z_6$. The single step reflector is applicable wherever the radius $R_5$ of envelope 27 or the opening 52 is not critical. Each of the reflectors illustrated in FIGS. 3, 5, and 6 are identical in principle, being reflectors symmetrical about their respective axis A while generating a variety of asymmetric and symmetric light patterns.

An asymmetric beam pattern utilizing the symmetric reflectors of FIGS. 3, 5, or 6 is provided by generating a distinct surface finish on the various reflector sections. This permits the generation of a variety of light patterns suitable for numerous applications while minimizing the percentage of wasted light. The various surfaces may be defined as specular, semi-specular, or diffused. Each surface has a distinct reflectance factor, defined as the percentage of light reflected by the reflector surface based on the intensity of light directed to the surface. For example, a surface having a reflectance factor of 85% means that the surface is capable of producing a reflected beam of 85 candle power from a source beam of 100 candle power. In practice, reflectance factors may vary from 10% for a dull black surface to 93% for a highly polished, mirror finish. Lamp reflectors generally are in the 50%–93% range. Reflecting surfaces are generally classified as having specular, semi-specular, or diffused finishes, specular having a reflectance factor of 78%–93% semi-specular having a reflectance factor of 62%–78% and diffused having a reflectance factor of 50%–62%.

The reflectors of the present invention utilize two of three possible distinct surface finishes to generate a desired asymmetric light pattern. As shown in Table I, the three surface finishes have distinct characteristics, to wit:

TABLE I

| Type Finish | Reflec. Factor | Beam Generated | Maximum Candlepower (cp) | Lamp Size |
|---|---|---|---|---|
| Specular | 85% | Narrow | 27,200 cp | 400w H.I.D. 32,000 rated lumens |
| Semi-Specular | 62% | Medium | 19,840 cp | 400w H.I. D. 32,000 rated lumens |
| Diffused | 53% | Wide | 16,960 cp | 400w H.I.D. 32,000 rated lumens |

The figures of Table I are derived from a typical 400 watt H.I.D. lamp having a rated output of 32,000 lumens, and are only exemplary, not taking into consideration such factors as reflector size and shape, utilizing only the theoretical output of a parabolic reflector with the various surface finishes.

Using the examples of Table I, it can be seen that a specular, or mirror, finish having a high reflectance factor (85%) generates a narrow, intense light beam, while the diffused finish having a low reflectance factor (53%), generates a wide beam of lower intensity, here 62.5% of the intensity generated by a specular surface. A semi-specular finish is generally mid-range, producing a medium width beam of mid-range intensity. By combining these various surfaces finishes in a predetermined manner on the symmetric reflector of FIGS. 3, 5, or 6, it is possible to generate the desired asymmetric light pattern.

Figure 7:
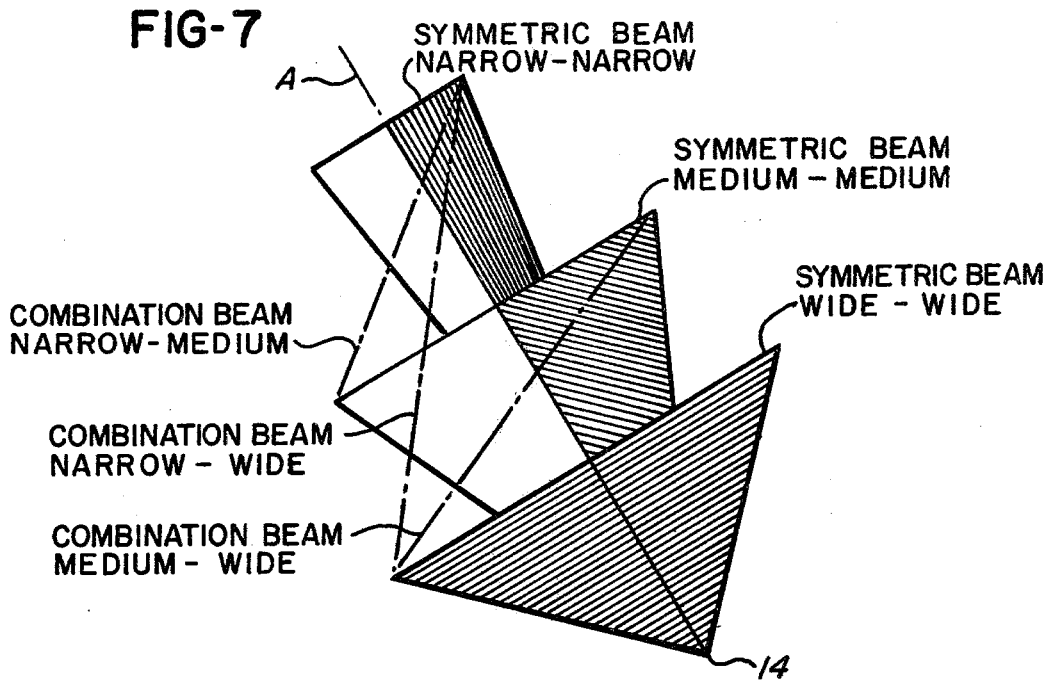
FIG. 7 is a composite representation of the various light patterns produced by reflector halves having selected surface finish combinations.

The various light patterns of the present invention are illustrated in FIGS. 7–10. The composite of FIG. 7 shows the effect of the various surface finishes when used in conjunction with reflector 22 of luminaire 14. The reflector is symmetric about the axis and may be, for example any of the reflectors illustrated in FIGS. 3, 5, and 6. The distance along axis A indicates intensity, the greater distance equalling higher intensity, while the width of the various beams indicate the vertical span and the shaded areas indicate a pattern shape. Horizontal or lateral span is substantially identical for all combinations and is not shown. When both halves of the reflector are of specular surface finish, the narrow high intensity beam designated narrow-narrow is generated. Where both halves are of diffused finish, the wide beam of low intensity designated wide-wide results. Use of the semi-specular reflector provides the medium beam of mid-range intensity designated medium-medium.

Since the reflector halves are interchangeable, it is possible to combine the various finishes, to provide asymmetric beam patterns suitable for a variety of applications. In the present embodiment, six distinct combinations are possible, viz: specular/specular, specular/-semi-specular, specular/diffused, semi-specular/semi-specular, semi-specular/diffused, and diffused/diffused. As illustrated in FIG. 7, the various combinations provide distinct symmetric and asymmetric light patterns. Table II summarizes the various combinations and resulting light patterns:

TABLE II

| SURFACE COMBINATION | RESULTANT BEAM (As noted in Fig. 7) | CLASS |
|---|---|---|
| Specular/Specular | Narrow-Narrow | Symmetric |
| Specular/Semi-Specular | Narrow-Medium | Asymmetric |
| Specular/Diffused | Narrow-Wide | Asymmetric |
| Semi-Spec/Semi-Spec. | Medium-Medium | Symmetric |
| Semi-Specular/Diffused | Medium-Wide | Asymmetric |
| Diffused/Diffused | Wide-Wide | Symmetric |

It should be understood that the various surfaces can be placed on either half of the reflector sections for producing nine possible reflector combinations. Each of the combinations has a distinct or characteristic application range, yet luminaire 14 may be utilized to provide any one of a plurality of different, distinctive and predictable light patterns by simply selecting reflector halves having the proper reflective surface finishes.

Figure 8:
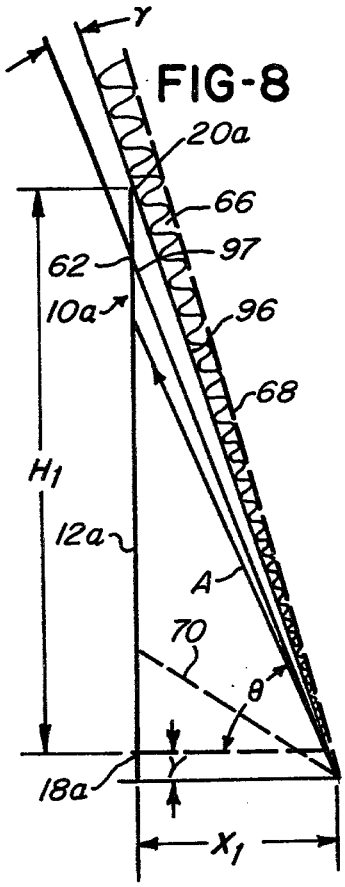
FIG. 8 is a graphic representation of a narrow-medium light pattern obtainable from reflector halves having specular and semi-specular surface finishes, respectively.
Figure 9:
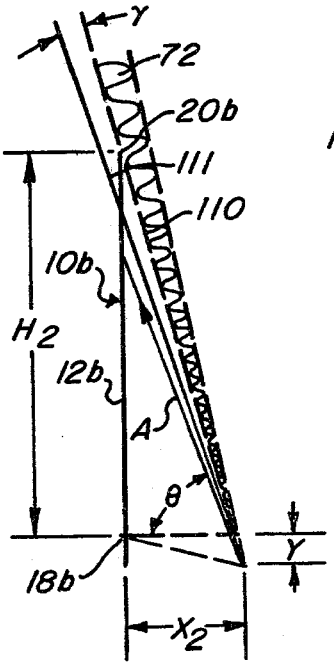
FIG. 9 is a graphic representation of a narrow-wide light pattern obtainable from reflector halves having specular and diffused surface finishes, respectively.
Figure 10:
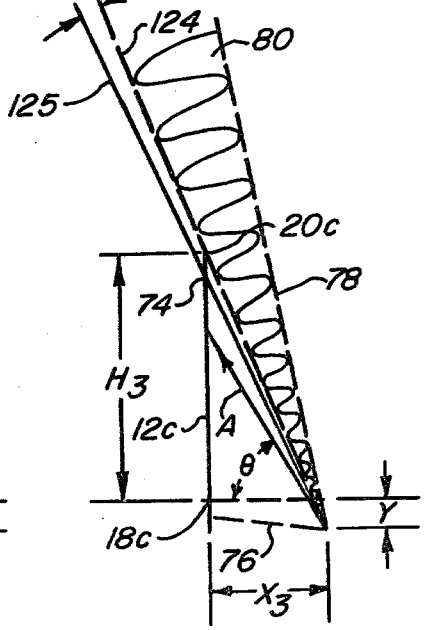
FIG. 10 is a graphic representation of a medium-wide light pattern obtainable from reflector halves having semi-specular and diffused surface finishes, respectively.

FIGS. 8, 9, and 10 illustrate exemplary applications of each of the asymmetric beams shown in FIG. 7 which are obtained from identical reflector halves having different reflective surface finishes.

FIG. 8 illustrates use of the narrow/medium beam; FIG. 9 illustrates the narrow/wide beam; and FIG. 10 illustrates the medium/wide beam. The height of each signboard 10*a*, 10*b*, and 10*c* is represented by $H_1$, $H_2$, and $H_3$, with $H_1$ being greater than $H_2$ which is in turn greater than $H_3$. The set back distance $X_1$ is generally greater than $X_2$ and $X_3$, but this is simply a matter of practice and is not necessary. The drop distance Y is identical for all cases illustrated.

For vertical surfaces or signs of substantial height $H_1$, the narrow/medium beam combination has been shown to produce the best results, even though the narrow/-wide combination gives the greatest variation in lamp intensity, see FIG. 7. This is because the distinction between the high intensity beam directed to the top of 20*a* of surface 12*a* and the low intensity directed near the bottom 18*a* is too great, causing bright spots at the top and dark spots at the bottom of the signboard 10*a*. Thus, by increasing the set-back $X_1$, the narrow/-medium combination provides desirable results. The strongest part of the beam is directed near the top 20*a* of the signboard, generally slightly off-set from the top to minimize the wasted light. Here, the brightest portion of the beam strikes the surface 12*a* at point 62, the off-set angle $\gamma$ being the included angle between line 97 and line 96, the lines extending from the focal center of the reflector to point 62 and top 20*a*, respectively. The angle $\gamma$ is generally in the range of 3°–5° and is usually determined at installation. This is usually predetermined by the mounting angle $\theta$, see FIG. 1, but neither angle is critical, the best resulting readability generally controlling the mounting angle of luminaire 14. As can be seen, there is a narrow band 66 of wasted light generated when the beam is mounted in this manner, however, the greatest percentage of the light is directed on surface 12*a* and the wasted band 66 is kept to a minimum.

In order to understand the basis of the asymmetric light pattern utilized with the present invention, it should be understood that the light beam represented by dotted lines 68 and 70 represents approximately 80% of the light emitted from luminaire 14. The remaining 20% is scattered on either side of the boundaries 68 and 70. Therefore, the concentrated beam bounded by the lines 68 and 70 is generally referred to as the working beam, the remaining 20% of generated light being non-usable. By utilizing the beams generated by the combinations of the present invention, the wasted portion of the working beam is kept to a minimum.

The light beam of FIG. 9 is the result of a wide/narrow combination, the narrow portion being directed to the top 20*b* of signboard 10*b*. Since the same narrow beam type is utilized in the top half of the combination as in the example of FIG. 8, the wasted light band 72 is essentially equal to the band 66, where the included angle between line 110, corresponding to line 96 and line 111, corresponding to line 97 is essentially equal to $\gamma$. For smaller signs of height $H_3$, the wide/medium combination has proved to provide the most desirable light pattern, see FIG. 10. Again, the brightest part of the beam, indicated by strike point 74 is directed such that included angle $\psi$ between the lines 124 and 125 is in the range of 3°–5°. However, since the medium beam is used, rather than the narrow beam of FIGS. 8 and 9, the brightest part of the beam, see line 125, is nearer the center of the entire beam pattern bounded by lines 76 and 78, generating a wider wasted band 80. It should be noted that the intensity of the medium beam is substantially below that of the narrow beam, therefore, the total quantitative wasted light varies only to an insignificant degree when the various beams are correctly utilized.

Referring now to FIG. 1, the distance "Z" between luminaires 14, 15, 16, and 17 does not vary significantly with respect to the beam combination utilized to get proper vertical lighting. The critical factor is uniformity, and the symmetric reflectors of the present invention ensure uniform lateral lighting as well as providing variable vertical intensity.

Figure 11:
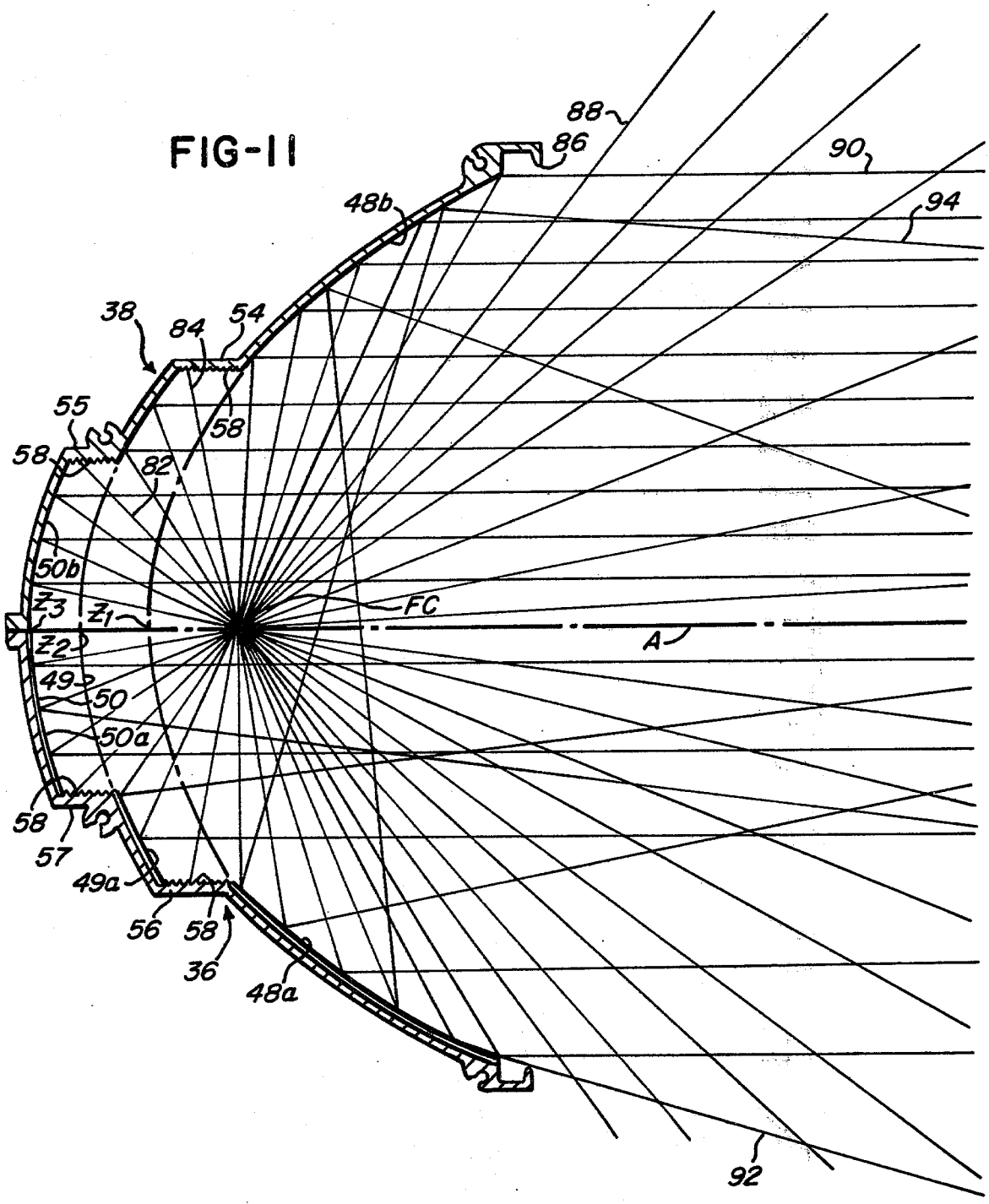
FIG. 11 is a cross-section of the preferred reflector, showing light emission rays or lumens.
Figure 11A:
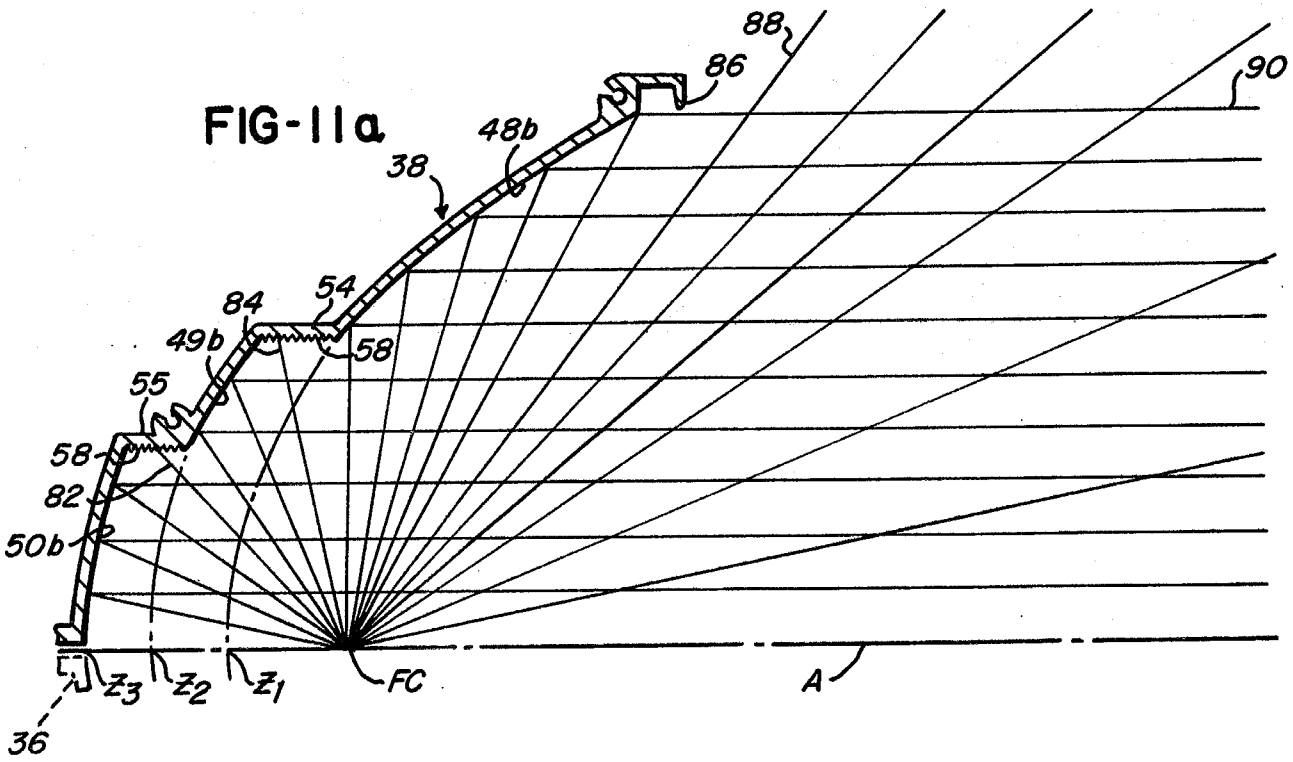
FIG. 11*a* is a partial view of the reflector of FIG. 11, showing the lumens reflected from the top half of the reflector.
Figure 11B:
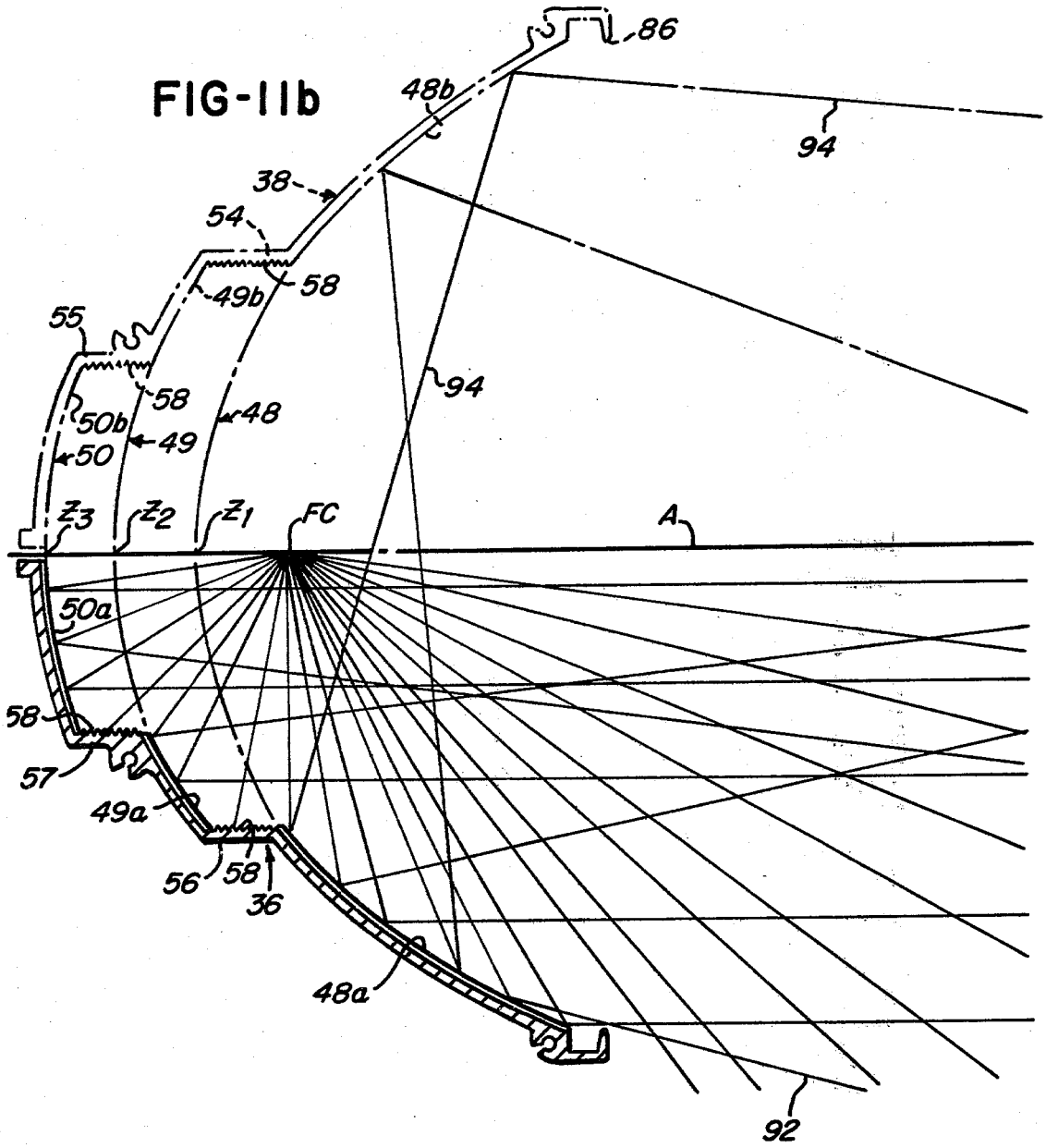
FIG. 11*b* is a partial view of the reflector in FIG. 11, showing the light emission lumens reflected from the bottom half of the reflector.

FIGS. 11, 11*a*, and 11*b* illustrate the reflection pattern of the preferred embodiment utilizing the narrow/-medium combination. The bottom half 36 of the reflector has surfaces 48*a*, 49*a*, and 50*a* all of semi-specular finish, indicated by the double line. The complementary surfaces 48*b*, 49*b*, and 50*b* of top half 38 have a specular finish. Each transition surface 54–57 is substantially parallel to axis A and includes or is defined by serrations 58. A light source is placed at the coinciding focal centers FC of the three parabolic curves 48, 49, and 50. Each of the lines emanating from the focal center represent lumens directed from the light source toward the reflector and reflector opening.

While FIG. 11 illustrates the light pattern generated by the composite narrow/medium reflector, it will be beneficial to deal with each reflector half 36 and 38 separately as shown in FIGS. 11*a* and 11*b*. The top reflector section 38 is illustrated in FIG. 11*a* and represents the intense, narrow light pattern of the specular finish. Since all the reflecting surfaces are parabolic, and the light emanates from the focal center of the reflector, each lumen hitting the reflector surface will be directed outward through the front opening along a path parallel to the reflector axis A. Thus, a narrow, intense beam is generated. Certain lumens, particularly lumens 82 and 84 as illustrated, will be directed into serrations 58 of the various transition surfaces 54 and 55. Due to the uneven surface finish generated by serrations 58, the lumens are generally trapped, their energy being expended by bouncing back and forth within the serrations. This is to ensure that the light directed to the transition surfaces is not directed back toward the focal center of the reflector. Certain other lumens will be directed outward beyond the end 86 of reflector half 38, not being reflected prior to release from the luminaire, see for example lumen 88. However, the greatest percentage of light emitted by a source at focal center FC is maintained in the narrow band defined by lumen 90 and the axis A. This is defined as the working beam of the top half of the reflector.

The bottom half 36 of the reflector is illustrated in FIG. 11*b* with the top half 38 shown in phantom. The surface of each section 48*a*, 49*a*, and 50*a* has a semi-specular finish, represented by the double line, as opposed to the specular finish of sections 48*b*, 49*b*, and 50*b*. The majority of the lumens emanating from the source at focal center FC are, as before, directed along the path parallel to the axis A after striking the surfaces 48*a*, 49*a* and 50*a*. However, due to the semi-specular finish, these lumens upon reflection are of lesser intensity. For example, the lumens in the top half of the working beam will be 85% of the intensity of the lumens emitted from the source, while those in the bottom will be of approximately 62% of the source intensity, see Table I. Further, due to the rougher surface, some of the lumens, see particularly lumens 92 and 94, will be deflected from a path parallel to axis A, generating a broader working beam. Again, as with top half 38, lumens directed to serrations 58 of members 56 and 58 are generally there absorbed. Thus, the working beam of the semi-specular reflector half 36 is defined by lumen 92 and axis A, being somewhat broader and less intense than the working beam of the specular reflector half 38. When the halves are combined, to form the reflector of FIG. 11, the beam generated is the narrow/medium beam of FIGS. 7 and 8, defined by lumens 90 and 92.

Figure 12:
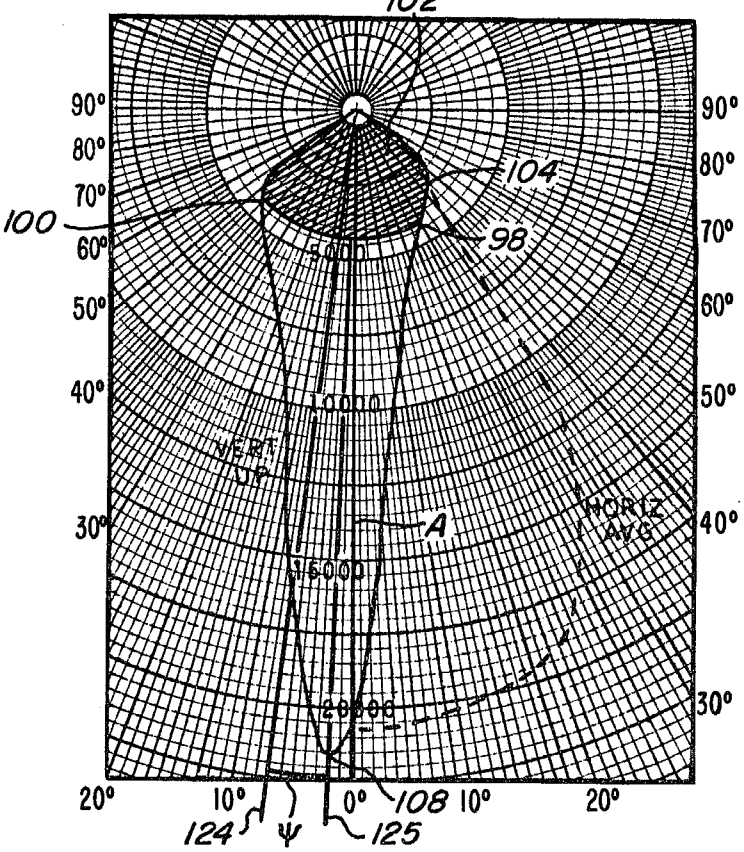
FIG. 12 is a candle power distribution polar graph of the semi-specular/diffused beam pattern.
Figure 13:
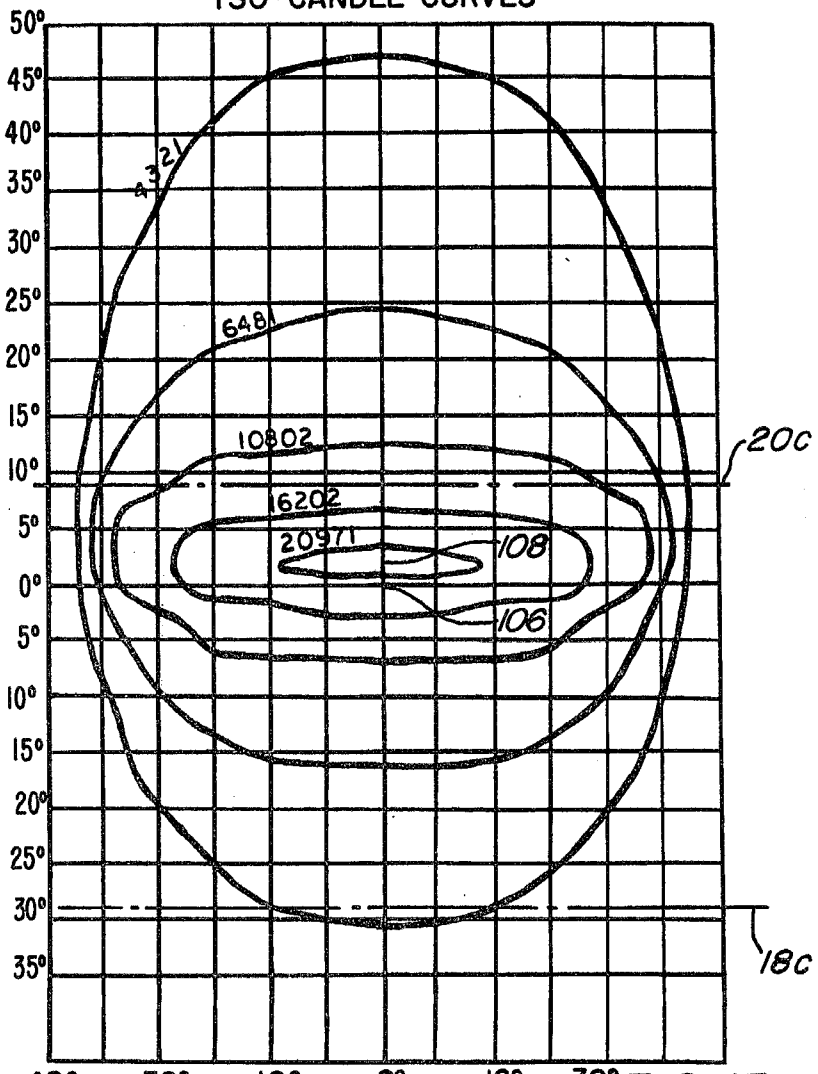
FIG. 13 is an iso-candle curve of the semi-specular/-diffused beam pattern.

Representative iso-curves and candle power curves of the various asymmetric patterns listed in Table II are illustrated in FIGS. 12–17. The candle power distribution curves of FIGS. 12, 14, and 16 are polargraphs showing the intensity of the light in candle power (cp) generated by the luminaire with respect to angular displacement from the axis A (0°) of the reflector in both the horizontal (dotted) and vertical (solid) directions. The iso-curves of FIGS. 13, 15, and 17 show the light pattern on a planar surface, angularly spanning both horizontally and vertically from the beam center (0°–0°). The iso-curves are limited to the working beam derived from the full candle power distribution shown in the candle power distribution graphs. All of the statistics contained in the graph are representative of a luminaire having approximately a 1 square foot lens and utilizing a 400 watt H.I.D. 32,000 rated lumens lamp.

FIGS. 12 and 13 are the respective curves for the medium/wide beam having combination semi-specular and diffused finishes, see FIG. 10. As can be seen, the strongest portion of the beam, having an intensity of 21,603 candle power is approximately 2° up, line 125 from the center of the beam at 0° corresponding to reflector axis A. Thus, if the angle $\psi$, were 5°, the candle power at the top 20*c* of the sign board 10*c* would be approximately 17,000, see line 124. That portion of the beam to the left of line 124 is wasted light, while that portion to the right is the used portion of the working beam. The candle power distribution decreases in a substantially linear manner when progressing downward (or to the right) from the most intense portion of the beam at point 108. This is ideal, since the bottom 18*c* of sign board 10*c* (See FIG. 10) is closer to the luminaire. The working pattern of beam is defined as the 80% portion of the beam (i.e. when the candle power drops to 20% of maximum the light beam becomes non-usable). In the example of FIG. 12, this occurs where the candle power drops to 4,321 cp, indicated by shaded area 102 and bounded by point 98 at 30° below the beam axis A and at point 100 at 47° above the beam axis. Thus, the vertical span of the medium/wide beam is 77°, the portion of that used in FIG. 10 being 37°, but encompassing the majority of usable light. This is determined by looking quantitatively at the curve in FIG. 12. The area bounded by line 124 and the solid curve to the right of line 124 down to point 98 encompasses quantitatively the amount of light utilized in the example of FIG. 10. The area to the left of line 124 including the solid curve down to point 100 and bounded by shaded area 102 encompsses quantitatively the amount of usable light generated but not utilized by the example of FIG. 10. Thus, even though only 37° of the 77° span is here utilized the greater quantitative portion of the working light beam is in the useful beam pattern.

The horizontal candle power distribution is symmetric about the beam axis A due to the symmetrical shape of the reflector and therefore only one-half of the curve is illustrated in FIG. 12. As can be seen, the candle power distribution is fairly constant, the maximum at the beam axis being 20,700 cp and dropping only to 15,000 cp at 30° from either side of the axis. The 20% level is at 4,140 cp at 44°, indicated at point 104. Thus, the working beam horizontally spans 88° with a 60° span having light varying from maximum to approximately two-thirds maximum. Referring to FIG. 1, it can be seen that where more than one luminaire is used, a certain amount of overlap will even out the 14° horizontal span below two-thirds maximum intensity on either side of the beam axis. Thus, the horizontal intensity is substantially level and uniform. Further, as can be seen from FIG. 1, since the horizontal span is known, here 88°, the distance "Z" is totally dependent upon the set back distance "X".

The iso-candle curve of FIG. 13 is generated from the working beam or 80% level of the candle power distribution curve of FIG. 12 and serves to illustrate the light pattern as projected on a planar surface, for example, surface 12*c* of FIG. 10. The curve is read like a geographic relief map, the various lines indicating different candle power being analogous to the various elevation lines of a typical topography. The beam axis or reflector axis is indicated at point 0°–0° as 106. At approximately 2° up from point 106 is the peak or point of highest intensity 108. As read from FIG. 12, the vertical working span of the beam is 47° up from the beam axis and approximately 30° below the beam axis or a total span of 77°. The candle power at this point is 20% of the maximum. Likewise, the horizontal span is 44° in either direction from point 106. The top 20*c* and bottom 18*c* of surface 12*c* of FIG. 10 are illustrated in phantom lines across the grid face, showing the wasted light region above 20*c*. As can be seen from the curves of FIG. 13, the horizontal intensity is symmetrical and relatively constant, being approximately two-thirds of maximum at a point 30° from either side of point 106. It can be seen that the vertical pattern is asymmetrical and rapidly changing in either direction from point 106. Thus, the symmetric reflector of the present invention with, different surface finishes on each reflector half section provides a suitable varying vertical pattern while maintaining a relatively constant horizontal light beam.

FIGS. 14 and 15 are curves similar to FIGS. 12 and 13, but illustrate the light pattern generated by the narrow/wide beam, see particularly FIG. 9. The strongest portion of the beam, having an intensity of 35,128 cp is approximately 1.5° up from the center of the beam, see line 111. If the angle $\gamma$, see FIG. 9, were 5°, the candle power at the top **20*b* of sign board 10*b* would be approximately 15,000 cp, see line 110. That portion of the beam to the left of 110 is wasted light, while that portion to the right is the usable portion of the working beam. The candle power distribution decreases again in a substantially linear manner from the peak point at 1.5°. The 20% portion of the beam is at the 7.026 cp level indicated by shaded area 116 and bounded by points 112 and 114. Thus, the vertical span of the narrow/wide beam is 30°, the portion of that used in FIG. 9** being approximately 21°, again encompassing the majority of usable light.

Again, the horizontal candle power distribution is symmetrical about the beam axis A. As can be seen, the candle power distribution is fairly constant, the maximum beam at the beam axis being 31,400 cp and dropping to 20,500 cp at 30°. The 20% level is at approximately 6,000 cp at 43° indicated at point 118. Thus, the working beam horizontally spans 86° with a 60° span again having light varying from a maximum to approximately two-thirds maximum.

The iso-candle curve of FIG. 15 is generated from the working beam or 80% level of the candle power distribution curve of FIG. 14. The planar surface **12*b* is indicated in the grid pattern with top line 20*b*, and bottom line 18*b* being included in phantom. The beam axis or reflector axis is indicated at (0°-0°) as numeral 120. At approximately 1.5° up from point 120 is the peak or highest point of intensity indicated as numeral 122. The vertical working span of the beam is 17° up from point 120 and 13° down from point 120, or a total span of 30°. The candle power at the boundary points is 20% of the maximum. The horizontal span is 43° in either direction from point 120**.

FIGS. 16 and 17 are again similar to 12 and 13 but illustrate the light pattern generated by the narrow/-medium beam, see particularly FIG. 8. The strongest portion of the beam, having an intensity of 39,624 cp, is approximately 2° up from the center of the beam, see line 125. Thus, if the angle $\gamma$, see FIG. 8, were 5°, the candle power at the top **20*a* of the signboard 10*a* would be approximately 20,000 cp as indicated by line 96. That portion of the beam to the left of line 96 is wasted light, while that portion to the right is again the usable portion of the working beam. Again, the candle power distribution decreases in a substantially linear manner when progressing downward (or to the right) from the point 136 of highest intensity, line 97. The 20% level is indicated at 7,925 cp and encompasses shaded area 130 bounded by points 126 and 128. Thus, the vertical span of the narrow/medium beam is 23°, the portion of that used in the example of FIG. 8** being 17°.

The horizontal candle power distribution is symmetric about the beam axis A at 0° due to the symmetrical shape of the reflector, and therefore only one-half of the curve is illustrated. As can be seen, the candle power distribution is fairly constant, the maximum at the beam axis being approximately 36,000 cp and dropping to 30,500 at 30°. The 20% level is at 6,250 cp or 42.5° from the beam axis, indicated at 132. Thus, the working beam horizontally spans 85°, with a 60° span having a light varying from maximum to approximately 80% maximum.

The iso-candle curve of FIG. 17 is generated from the working beam or 80% level of the candle power distribution curve of FIG. 15 and contains line **20*a*, indicating the top, and line 18*a*, indicating the bottom of planar surface 12*a* as shown in FIG. 8. The beam axis or reflector is indicated at point 134 with the peak intensity level being indicated at approximately 2° up at point 136. The vertical working span of the beam is approximately 13° up from point 134 and 10° down from point 134 or a total span of 23°. The candle power at these boundaries is 20% of the maximum. Likewise, the horizontal span is 42.5° in either direction from point 134**.

It should be understood that the various symmetrical and asymmetrical light patterns generated and here disclosed are merely illustrative. For example, it would be possible to vary the surface finishes of each section of the reflector shown in FIG. 3, **48*a* differing from 49*a* and each of these likewise differing from 50*a*** continuing through the bottom half where again each surface could vary in some degree. While particular embodiments have been here shown for purposes of illustration, it should be understood that these embodiments are not intended to limit the scope of the appended claims nor the spirit of the invention.

SUMMARY OF THE INVENTION

From the foregoing, it will be noted that I have provided apparatus for and a method of producing a plurality of different, distinctive, and predictable light patterns relative to the beam axis of a reflector which comprises a pair of mirror-image reflector half-sections, wherein the light patterns are a function of the reflectance factor of the reflective surface of each reflector section.

Three generic light patterns are obtainable, from each composite reflector, viz a narrow, intense beam generated by a reflective surface of specular finish having a reflectance factor in the range of 78%-93%; a medium beam generated by a reflective surface of a semi-specular finish having a reflectance factor in the range of 62%-78%; and a wide, scattered beam generated by a reflective surface of diffused finish having a reflectance factor in the range of 50%-62%.

Since the composite reflector is comprised of duplicate half-sections, the reflective surface of each of which are provided with a particular reflective surface finish, any one of six possible light patterns, as illustrated in FIG. 7, may be generated.

Where the duplicate half sections are interchangeable, as for example, in the reflectors of FIGS. 3, 5 or 6, each of the six patterns may be selectively produced by utilizing the proper reflective surface finish for the respective halves.

Due to the symmetric configuration of the reflectors, the light pattern generated in the plane orthogonal to that shown in FIG. 7 is symmetrical about the beam axis and is relatively constant regardless of the particular reflective surface utilized. For example, FIGS. 12–17 graphically illustrate the three possible asymmetrical patterns for a reflector having approximately one foot square lens opening. As can be seen in the iso-candle curves of FIGS. 12, 15, and 17, the vertical light pattern varies greatly when the reflective surfaces are changed from specular/semi-specular (FIG. 13), to specular/diffused (FIG. 15), or to semi-specular/diffused (FIG. 17), while the horizontal or lateral light pattern remains relatively constant for all three.

Thus, the present invention provides three different, distinctive, and predictable asymmetric light patterns greatly varying in one direction with respect to the beam axis while maintaining constant, predictable symmetric light patterns in the orthogonal direction with respect to the beam axis.

As illustrated in FIG. 7, three symmetrical light patterns are also obtainable when reflective surfaces of like finish are utilized for each half-section. Thus, the user is provided with an entire family of predictable light patterns permitting utilization of the luminaire in the most convenient manner while minimizing wasted light and maximizing luminaire efficiency, providing even, uniform light on a surface to be illuminated, enhancing readability and improving aesthetic appearance.

It should be understood that the present invention is neither directed to nor concerned with the particular technique or manner in which the various finishes are provided on the reflective surfaces of the reflector halves, since such techniques are old and well known in the art.

What is claimed is:

1. A method of producing one of a plurality of distinctive and predictable symmetric or asymmetric light patterns from a reflective surface of fixed contour which comprises the steps of: providing a plurality of pairs of duplicate, mirror-image fixed contour reflector half-sections; providing each half-section with a reflecting surface finish whose reflectance factor is in a range selected from the group of ranges consisting of the ranges of 50%–62%, 62%–78% and 78%–93%; selecting pairs of half-sections according to their particular reflectance factors for providing a particular symmetric or asymmetric light pattern; joining selected pairs of said half-sections to form a reflector having a composite reflector surface of symmetric configuration; providing an elongate light source at a focal center adjacent the reflector surface and in parallelism with the beam axis of the composite reflector surface; wherein the reflectance factor of the surface finish of each half-section determines the width of that portion of the particular overall light pattern of the reflector as contributed by each half-section.

2. An assemblage for forming a plurality of different linear concave reflectors, comprising: a plurality of identical, elongate, mirror-image, arcuately shaped half-sections, each of said half-sections having one of a plurality of different reflecting surface finishes thereon, said half-sections each having substantially parallel longitudinal edges and each having a concave side and a convex side, means for interconnecting selected pairs of half-sections together along adjacent longitudinal edges thereof for defining a continuous, concave reflector surface, each half-section of a pair having at least one predetermined, selected reflecting surface finish on the concave side thereof for producing one of a plurality of distinctive, predictable, preselected reflected asymmetric or symmetric light patterns, whereby selected pairs of half-sections may be obtained from said plurality of different reflector half-sections and the selected half-sections coupled together in predetermined pairs to selectively produce one of said plurality of distinctive, predictable different light patterns, thus resulting in a reflector which can be produced with a given fixed contour and selected from a stock of various reflector halves having predetermined reflecting surfaces thereon, such that different reflector halves when coupled together produce one of the plurality of predictable light patterns.

3. An assemblage as called for in claim 2 wherein the means interconnecting the selected pairs of half-sections include an elongate, grooved track-defining member on the adjacent edges of each of the half-sections, and an elongate, substantially channel-shaped coupling member engaging said track-defining member and their respective grooves.

4. A method of producing any one of a plurality of different, distinctive and predictable symmetric and asymmetric light patterns from an elongate reflective surface of fixed contour which comprises the steps of: providing a plurality of reflector half-sections each having a predetermined reflecting surface finish with a known reflectance factor, wherein some of the reflectance factors are different; selecting a pair of duplicate, mirror-image, fixed contour, reflector half-sections; joining said selected half-sections to form a reflector having a composite reflector surface of symmetric, linear configuration; and providing an elongate light source at a focal center on the reflector surface and in parallelism with the beam axis of the composite reflector surface; wherein the surface finish of each half-section determines that portion of the particular overall light pattern of the reflector as contributed by each half-section, whereby a plurality of substantially identically shaped half-sections may be manufactured and stockpiled, with various reflecting surface finishes thereon, and desired pairs of half-sections selected and coupled together to provide one of a plurality of desired reflected light patterns, from a reflector of fixed, symmetrical contour.

5. A method of selectively producing any one of a plurality of different, distinctive, and predictable symmetric or asymmetric light patterns relative to the beam axis of a symmetric, linear, concave reflector of the type which comprises a pair of interconnected, duplicate, mirror-image half-sections each including a reflecting surface, which comprises the steps of:

a. providing a plurality of mirror-image, elongate, arcuately shaped upper and lower reflector half sections each having a reflecting surface;
b. providing some of said half-sections with a reflecting surface finish having a reflectance factor in the range of 78%–93%;
c. providing other of said half-sections with a reflecting surface finish having a reflectance factor in the range of 62%–78%;
d. providing still other of said half-sections with a reflecting surface finish having a reflectance factor in the range of 50%–62%;
e. selecting pairs of half-sections according to their reflectance factors for providing a particular overall symmetric or asymmetric light pattern, and then
f. interconnecting the selected half-sections to provide a symmetric, linear, concave reflector.

6. A method as called for in claim 5 wherein the step of selecting pairs of half-sections includes a step of selecting pairs having reflecting surface finishes having the same reflectance factors for producing an overall symmetric reflected light pattern.

7. A method as called for in claim 5, wherein the step of selecting pairs of half-sections includes a step of selecting pairs having reflecting surface finishes having different reflectance factors for producing an overall asymmetric reflected light pattern.

8. A method of producing one of a plurality of different and distinctive symmetric or asymmetric light patterns relative to the beam axis of a symmetric, linear, concave reflector of the type which comprises a pair of interconnected, mirror-image half-sections each including a reflecting surface, which comprises the steps of:

(a) providing a pair of mirror-image, elongate, arcuately shaped upper and lower reflector half-sections each with a reflective surface;

(b) providing one or the other or both reflector surfaces with a reflecting surface finish having a reflectance factor range selected from the group consisting of the ranges of 78%–93%, 62%–78% and 50%–62%, wherein the reflected light pattern from each half-section is a function of its particular reflectance factor; and (c) interconnecting said half-sections to provide a symmetric, linear, concave reflector, wherein the reflected light pattern is symmetric when the reflectance factors of the half-sections are the same, and wherein the reflected light pattern is asymmetric when the reflectance factors of the half-sections are different.

9. An assemblage for forming a plurality of different reflectors each of which produces a distinctive and predictable symmetric or asymmetric reflected light pattern, comprising:

a plurality of elongate, arcuately shaped reflector half-sections, said half-sections being identically shaped;

a plurality of reflecting surface finishes, each of said half-sections having one of said plurality of surface finishes thereon; and coupling means for coupling a selected pair of said plurality of reflector half-sections together to form an elongate symmetrically shaped reflector having a predetermined combination of surface finishes for producing a light beam having a width determined according to the combination of surface finishes on said coupled half-sections.

10. An assemblage as called for in claim 9, wherein the reflecting surface finish of each interconnected reflector half section is identical for producing a symmetric reflected light pattern.

11. An assemblage as called for in claim 9, wherein the reflecting surface finish of each interconnected reflector half section is different for producing an asymmetric reflected light pattern.

12. An assemblage as called for in claim 9, wherein each half-section includes an elongate, rearwardly projecting track defining member, and wherein said coupling means comprises an elongate member which securely though releasably engages the track defining member of each half section.

13. An assemblage as called for in claim 9, wherein the elongate, symmetrically shaped, reflector comprises a parabolic curve the geometric center of which is on the axis of the reflector and defines a focal center thereof.

14. An assemblage as called for in claim 9, wherein each half-section includes two or more parabolic curved reflector sections having a common geometric center defining a single focal center on the axis of the reflector, and a transition surface connecting the adjacent edges of said parabolic sections.

15. A reflector as called for in claim 14, wherein said transition surface is non-reflecting and parallel with the reflector axis.

16. A reflector as called for in claim 14, wherein said transition surfaces are disposed in a plane which intercepts the reflector axis at an acute angle.

17. An assemblage as called for in claim 9, wherein the reflecting surface finish of at least one of said half-sections includes a reflectance factor in the range of 78%–93% for generating from said one half-section a narrow reflected light pattern.

18. An assemblage as called for in claim 9, wherein the reflecting surface finish of at least one of said half-sections includes a reflectance factor in the range of 62%–78% for generating from said one half-section a reflected light pattern of medium width.

19. An assemblage as called for in claim 9, wherein the reflecting surface finish of at least one of said half-sections includes a reflectance factor in the range of 50%–62% for generating from said one half-section a wide reflected light pattern.

* * * * *